US010881919B1

(12) United States Patent
Chuang

(10) Patent No.: US 10,881,919 B1
(45) Date of Patent: Jan. 5, 2021

(54) GOLF CLUB HEAD

(71) Applicant: Chi-Shun Chuang, Taichung (TW)

(72) Inventor: Chi-Shun Chuang, Taichung (TW)

( * ) Notice: Subject to any disclaimer, the term of this patent is extended or adjusted under 35 U.S.C. 154(b) by 0 days.

(21) Appl. No.: 16/716,946

(22) Filed: Dec. 17, 2019

(30) Foreign Application Priority Data

Nov. 8, 2019 (TW) ..... 108214851 U

(51) Int. Cl.
*A63B 53/14* (2015.01)
*A63B 53/04* (2015.01)

(52) U.S. Cl.
CPC ..... *A63B 53/0466* (2013.01); *A63B 53/0408* (2020.08); *A63B 53/0416* (2020.08); *A63B 53/0445* (2020.08)

(58) Field of Classification Search
CPC ..... B29L 2031/546; A63B 53/0466; A63B 60/00
USPC ..... 473/324
See application file for complete search history.

(56) References Cited

U.S. PATENT DOCUMENTS 5,433,440 A * 7/1995 Lin ..... A63B 53/04 473/342
6,749,524 B1 * 6/2004 Chen ..... A63B 53/04 473/342
2006/0281582 A1 * 12/2006 Sugimoto ..... A63B 53/047 473/346
2016/0346640 A1 * 12/2016 Boggs ..... A63B 53/0466
2017/0157474 A1 * 6/2017 Sander ..... A63B 23/03575

FOREIGN PATENT DOCUMENTS

RU 183203 * 9/2018

* cited by examiner

*Primary Examiner* — John E Simms, Jr.
(74) *Attorney, Agent, or Firm* — Muncy, Geissler, Olds & Lowe, P.C.

(57) ABSTRACT

A golf club head of the present invention is a combination of a main body and a faceplate. The main body has a top portion and a bottom portion. The main body is provided on a side thereof with a heel portion and on another side thereof with a toe portion. The front surface of the main body has an opening and a groove located at the opening. The groove is relatively narrower in width at the top portion and the bottom portion and relatively wider in width at the heel portion and the toe portion. The faceplate has a back surface provided with a protruding rib. The faceplate is disposed at the opening of the main body and the protruding rib is fitly inserted in the groove of the main body.

3 Claims, 5 Drawing Sheets

GOLF CLUB HEAD

BACKGROUND OF THE INVENTION

1. Field of the Invention

The present invention relates to golf clubs and more particularly, to a golf club head.

2. Description of the Related Art

A conventional golf club head is usually a two-piece or three-piece combination. A two-piece golf club head 1 is disclosed in FIGS. 1-3, which is a combination of a striking faceplate 2 and a main body 3. The main body 3 is provided on a side thereof with an opening 4 and a groove 5 located on the periphery of the opening. The striking faceplate 2 is correspondingly disposed at the opening and provided with a protruding rib 6. The striking faceplate 2 is combined with the main body 3 in a way that the protruding rib 6 and the groove 5 are combined with each other. Although the main body 3 and the striking faceplate 2 respectively have the groove 5 and the protruding rib 6 for combination, in practice the main body 3 and the striking faceplate 2 still need to be fixed to each other by soldering. The soldering process is usually performed in a way that solder is put in the groove 5 and put on the outer surface of the club head at the juncture and then the solder is melted to fixedly combine the main body 3 and the striking faceplate 2. However, such structure has a practical problem that the size of the groove 5 is influential in the necessary quantity of the solder and the bonding strength. The wider the groove is, the better the solder flows during the soldering process and thereby the fewer voids will be produced, but the weaker the bonding strength is. In contrast, the narrower the groove is, the higher the bonding strength is, the more solder is economized, but the worse the solder flows.

SUMMARY OF THE INVENTION

It is a primary objective of the present invention to provide a golf club head which is enhanced in the quality and bonding strength thereof.

To attain the above-mentioned primary objective, the present invention provides a golf club head which includes a main body and a faceplate. The main body has a top portion, a bottom portion, a heel portion and a toe portion. The main body is provided on a side thereof with an opening and a groove located at the opening. The groove is relatively narrower in width at the top portion and the bottom portion and relatively wider in width at the heel portion and the toe portion, so that the width of the groove is not uniform. The faceplate has a front surface and a back surface. The front surface is the striking face. The back surface is provided with a protruding rib fit to the groove of the main body.

DETAILED DESCRIPTION OF THE INVENTION

First of all, it is to be mentioned that the technical features provided by the present invention are unlimited to the specific structure, usage and application thereof described in the detailed description of the invention. It should be understood by those skilled in the related art that all the terms used in the contents of the specification are for illustrative description. The directional terms mentioned in the contents of the specification, such as 'front', 'upper', 'lower', 'back', 'left', 'right', 'top', 'bottom', 'inside', and 'outside', are also just for illustrative description on the basis of normal usage direction, not intended to limit the claimed scope.

Besides, the numeral terms with singular form, such as 'a', 'an' and 'the', used in the claims of the present invention all include the plural meaning. Thus, for example, the description for 'an element' refers to one or a plurality of elements and includes the equivalent replacements known by those skilled in the related field. All conjunctions used in similar conditions should be also understood in the broadest sense. The specific shapes and structural features or technical terms described in the contents of the specification should be also understood to include the equivalently replacing structures or technical terms capable of attaining the function of the specific structures or technical terms.

Figure 1:
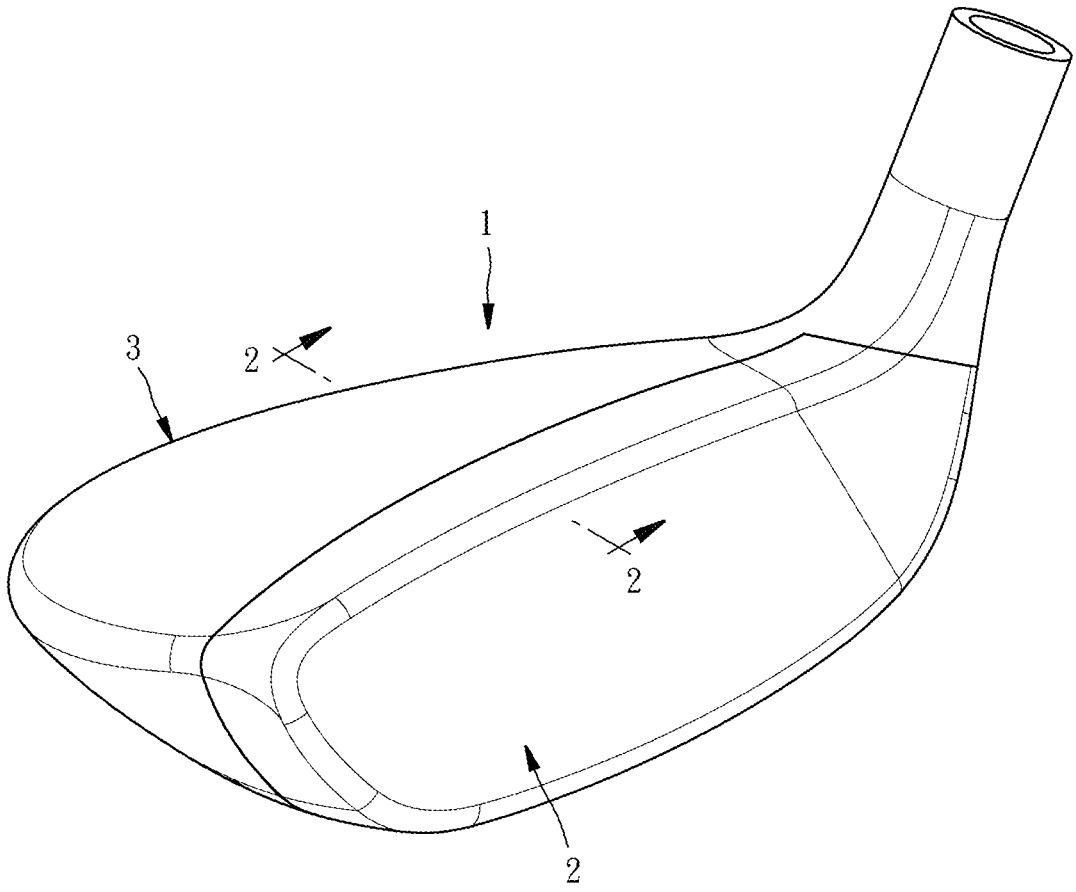
FIG. 1 is a schematic perspective view of the appearance of a conventional golf club head.
Figure 2:
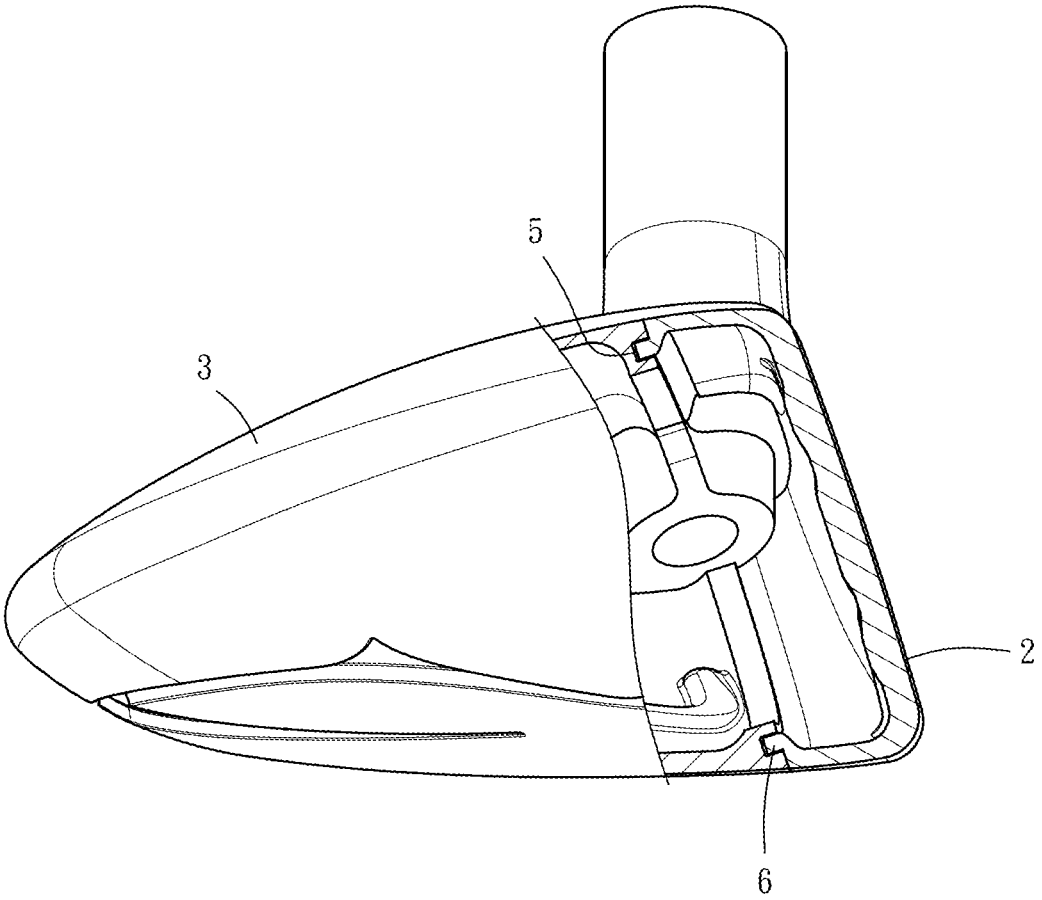
FIG. 2 is a partially sectional view taken along the line 2-2 in FIG. 1.
Figure 3:
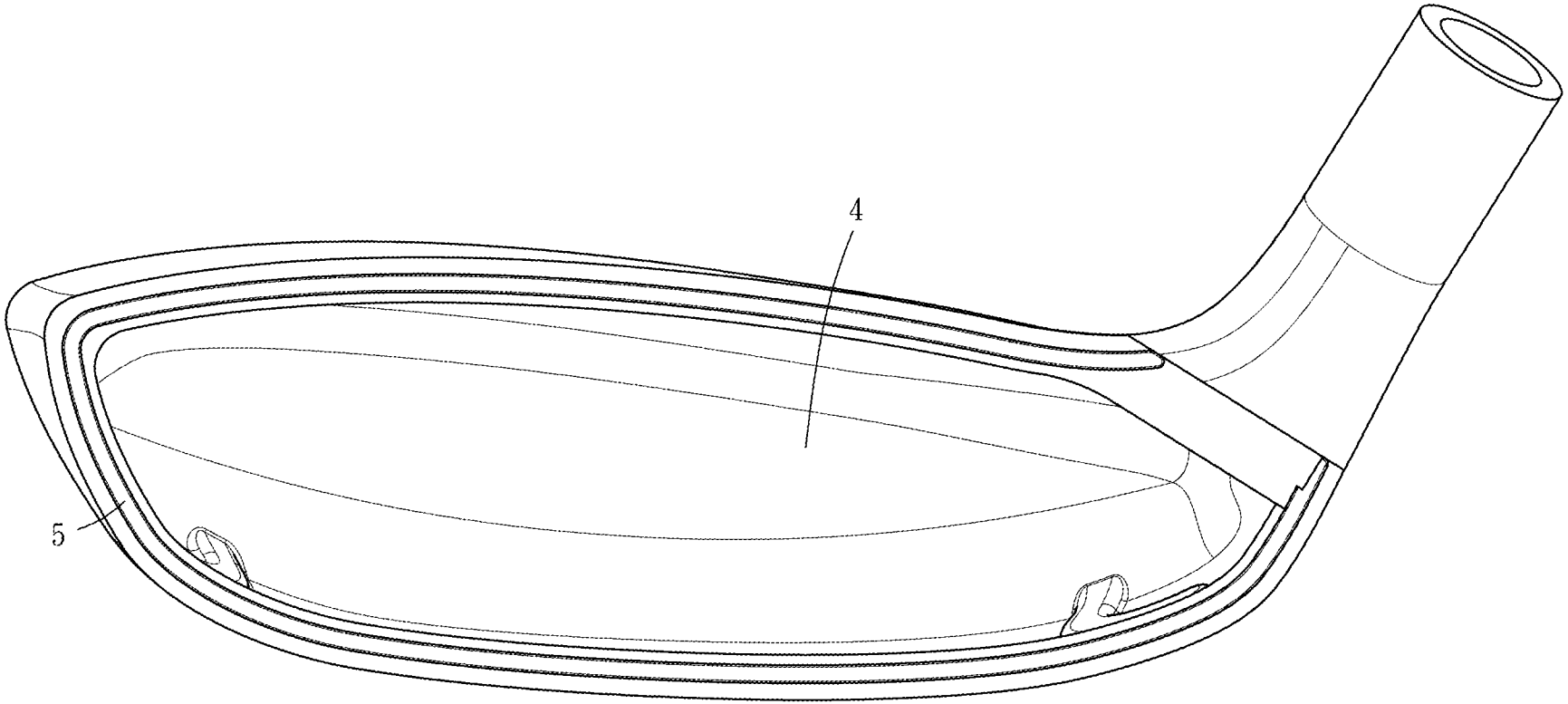
FIG. 3 is a schematic view showing a front surface of a main body in FIG. 1.
Figure 4:
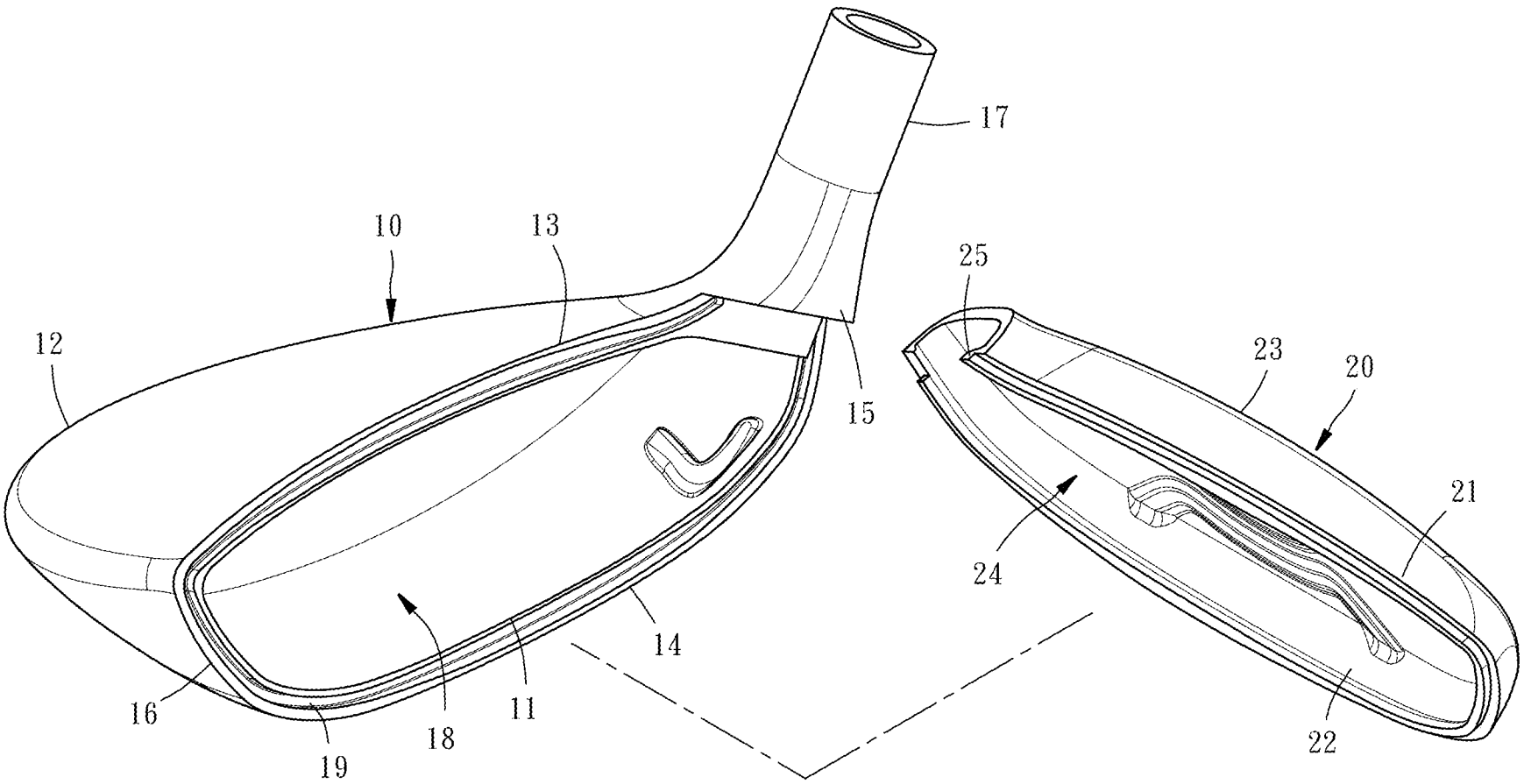
FIG. 4 is an exploded perspective view of the present invention.
Figure 5:
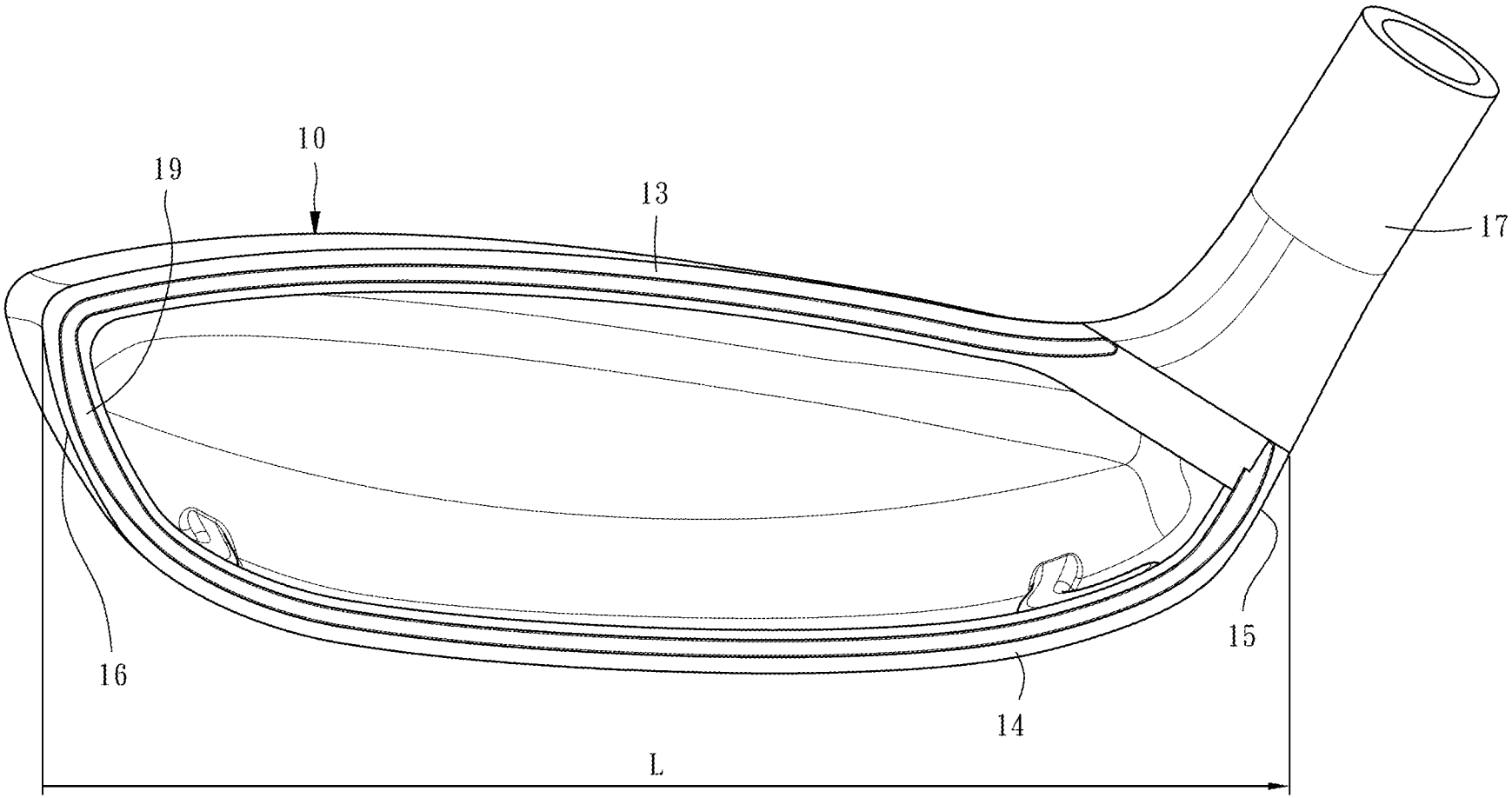
FIG. 5 is a schematic view showing a front surface of a main body of the present invention.

Referring to FIGS. 4 and 5, a golf club head of the present invention includes a main body 10 and a faceplate 20.

The main body 10 has a front surface 11 and a back surface 12. The main body 10 has a top portion 13 and a bottom portion 14. The main body 10 is provided on a side thereof with a heel portion 15. The heel portion 15 is provided with a neck portion 17 for the connection with a shaft (not shown). The main body 10 is provided on another side thereof with a toe portion 16 opposite to the heel portion 15. The front surface 11 of the main body has an opening 18 and a groove 19 located at the opening. The groove 19 is relatively narrower in width at the top portion 13 and the bottom portion 14 and relatively wider in width at the heel portion 15 and the toe portion 16. For example, in this embodiment, the total length of front surface of the main body 10 is defined as the distance between the leftest side and the rightest side of the main body and represented by L as shown in FIG. 5, a middle position of which is defined as a reference point located away from each of the leftest side and the rightest side for a distance of ½L. Within a scope extending from the reference point toward each of the leftest side and the rightest side for a distance ranged from ⅛L to ¼L, the width of the groove is ranged from ⅛ mm to ½ mm. The width of the remainder parts of the groove is ranged from ½ mm to 1 mm. The depth of the groove 19 is ranged from 5/100 mm to 30/100 mm.

The shape of the faceplate 20 corresponds to the shape of the front surface 11 of the main body. The faceplate 20 has a top portion 21, a bottom portion 22, a front surface 23 and a back surface 24. The back surface 24 of the faceplate is provided with a protruding rib 25. The front surface 23 of the faceplate is the striking face. The faceplate is disposed at the opening 18 of the main body and the protruding rib 25 is fitly inserted in the groove 19 of the main body. The protruding rib is shaped to fit the groove of the main body. The protruding rib is also relatively narrower in width at the parts corresponding to the top portion 13 and the bottom portion

14 of the main body and relatively wider in width at the parts corresponding to the heel portion 15 and the toe portion 16.

The main body 10 and the faceplate 20 in the present invention are combined and fixed to each other in a manner similar to the conventional manner. The main body 10 and the faceplate 20 are also fixed to each other by soldering. During the soldering process, solder is put in the groove 19. However, in the present invention, the groove 19 is relatively narrower in width at the top portion 13 and the bottom portion 14. Such design makes the bonding strength between the faceplate and the main body at the top portion 13 and the bottom portion 14 higher than that at the heel portion 15 and the toe portion 16, and reduces the voids produced in the groove 19, thereby attaining the objective of enhanced bonding quality and bonding strength. In the present invention, the main body is unlimited to a one-piece structure, but may be a two-piece structure. The primary feature is that the main body is provided with the groove whose width is not uniform, thereby attaining the objective of the present invention.

What is claimed is:

1. A golf club head comprising:

a main body having a front surface, a back surface, a top portion and a bottom portion, the main body being provided on a side thereof with a heel portion, the main body being provided on another side thereof with a toe portion opposite to the heel portion, the front surface of the main body having an opening and a groove located at the opening, the groove being relatively narrower in width at the top portion and the bottom portion and relatively wider in width at the heel portion and the toe portion;

a faceplate disposed on the front surface of the main body and shaped correspondingly to the main body to have a top portion and a bottom portion, the faceplate having a front surface and a back surface, the front surface of the faceplate being a striking face, the faceplate being disposed at the opening of the main body in a way that a protruding rib of the faceplate is fitly inserted in the groove of the main body, wherein a width of the groove at the top portion and the bottom portion of the main body is ranged from ⅛ mm to ½ mm, wherein a width of the groove at the heel portion and the toe portion is ranged from ½ mm to 1 mm.

2. The golf club head as claimed in claim 1, wherein a total length of the front surface of the main body is defined as a distance between a leftest side and a rightest side of the main body and represented by L, a middle position of which is defined as a reference point located away from each of the leftest side and the rightest side for a distance of ½L; within a scope extending from the reference point toward each of the leftest side and the rightest side for a distance ranged from ⅛L to ¼T.

3. The golf club head as claimed in claim 1, wherein a depth of the groove is ranged from 5/100 mm to 30/100 mm.

* * * * *